US007380530B2

(12) United States Patent
Schafer et al.

(10) Patent No.: US 7,380,530 B2
(45) Date of Patent: Jun. 3, 2008

(54) CAMSHAFT ADJUSTER WITH A SUPERPOSITION DRIVE

(75) Inventors: Jens Schafer, Herzogenaurach (DE); Mike Kohrs, Wilthen (DE); Falko Arnold, Nuremberg (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/675,843

(22) Filed: Feb. 16, 2007

(65) Prior Publication Data

US 2007/0193540 A1 Aug. 23, 2007

(30) Foreign Application Priority Data

Feb. 18, 2006 (DE) ..... 10 2006 007 651

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 4,747,375 A 5/1988 Williams
5,327,859 A * 7/1994 Pierik et al. ..... 123/90.17
2003/0226634 A1 12/2003 Gardner, Jr.

FOREIGN PATENT DOCUMENTS

| | | |
|---|---|---|
| DE | 3737602 | 5/1989 |
| DE | 3830382 | 1/1990 |
| DE | 4110195 | 10/1992 |
| DE | 10038354 | 2/2002 |
| DE | 10205034 | 8/2003 |
| DE | 10317607 | 11/2003 |
| DE | 10224446 | 12/2003 |
| DE | 10260546 | 7/2004 |
| DE | 10352255 | 6/2005 |
| EP | 1043482 | 10/2003 |
| WO | 03098010 | 11/2003 |

* cited by examiner

*Primary Examiner*—Zelalem Eshete
(74) *Attorney, Agent, or Firm*—Volpe and Koenig. P.C.

(57) ABSTRACT

A drive connection with a camshaft adjuster for an internal combustion engine is provided. A free end of the camshaft adjuster is coupled with an accessory unit, especially a vacuum pump, in a camshaft adjuster with a superposition drive and an electrical control unit. The electrical control unit (7) can be constructed as a hollow unit, through which a drive shaft of the accessory unit is passed.

4 Claims, 10 Drawing Sheets

CAMSHAFT ADJUSTER WITH A SUPERPOSITION DRIVE

CROSS-REFERENCE TO RELATED APPLICATIONS

This application claims priority from DE 10 2006 007 651.6, filed Feb. 18, 2006, which is incorporated by reference herein as if fully set forth.

BACKGROUND

The invention relates to a camshaft adjuster for an internal combustion engine.

Camshaft adjusters can be classified roughly as follows:

A. Phase adjusters with a control unit, that is, a functional unit, which engages in the mass flow or energy flow, which, for example, has a hydraulic, electric, or mechanical construction, and which rotates with gear elements of the camshaft adjuster.

B. Phase adjusters with a separate regulator, that is, a functional unit, in which the control parameter necessary for controlling the modulation of the control unit is derived from the regulator output parameter, and with a separate control unit. Here there are the following constructions:

a. Phase adjuster with a co-rotating actuator and a co-rotating control unit, for example, a speed increasing gearbox, whose adjustment shaft can be preset by a co-rotating hydraulic motor or centrifugal force motor and can be reset by means of a spring.

b. Phase adjuster with a co-rotating control unit and a stationary, motor-fixed actuator, for example, an electric motor or an electric or mechanical brake, see also DE 100 38 354 A1, DE 102 05 034 A1, EP 1 043 482 B1.

c. Phase adjuster with a direction-dependent combination of solutions according to a and b, for example, a motor-fixed brake, in which part of the braking power is used, for example, for shifting in the advanced direction, in order to tension a spring that can reset the brake after the brake is switched off, see also DE 102 24 446 A1, WO 03-098010, US 2003 0226634, DE 103 17 607 A1.

For systems according to B.a. to B.c., actuators and control units are connected to each other by means of an adjustment shaft. The connection can be switchable or non-switchable, detachable or non-detachable, without backlash or with backlash, and flexible or stiff. Independent of the structural shape, the adjustment energy can be realized in the form of providing driving and/or braking power, as well as using loss power of the shaft system (e.g., friction) and/or inertial and/or centrifugal forces. Braking, preferably in the "retarded" adjustment direction, can also be realized under complete use or co-use of the frictional output of the camshaft. A camshaft adjuster can be equipped with or without mechanical limiting of the adjustment range. As the drive in a camshaft adjuster, one-stage or multiple-stage triple-shaft drives and/or multiple linkages or coupling gears can be used, for example, with a structural shape as a swashplate mechanism, eccentric drive, planetary gear drive, shaft drive, cam plate drive, multiple linkage or coupling drive, or combinations of the individual structures for a multiple-stage configuration.

While conventional, hydraulically activated camshaft adjusters or camshaft adjusters in a construction with vane cells, pivot vanes, or segmented vanes have the advantage that The hydraulic medium can be fed into the camshaft adjuster at any point for control, The hydraulic medium is fed into the camshaft adjuster via suitable flow channels, The hydraulic medium—if necessary—can be diverted and Suitable devices for controlling the hydraulic pressure can also be arranged eccentric from the camshaft adjuster, in conventional camshaft adjusters, in which the control movement is generated via an electric motor and a superposition drive, triple-shaft drive, or planetary gear drive (in the following superposition drive), see, e.g., DE 41 10 195 A1, the electric motor is typically arranged in front of the superposition drive aligned to the longitudinal axis of the camshaft and the superposition drive. For this reason, such camshaft adjusters with an electric control unit and a superposition drive are built axially larger than corresponding hydraulically actuated camshaft adjusters. Attaching an accessory unit, such as a vacuum pump, to the camshaft adjuster on the side of the superposition drive facing away from the camshaft is not possible, because the electric control unit is arranged in this installation space.

From DE 37 37 602 A1 it is known to use a differential gear drive as the superposition drive, in which a drive is realized via a driving wheel in driving connection with the crankshaft and a driven part relative to the camshaft aligned with the longitudinal axis, while the feeding of the drive motion of the electric control unit is realized radially relative to the previously mentioned longitudinal axis.

From DE 102 60 546 A1, a hydraulic camshaft adjuster is known, to which a vacuum pump can be coupled on the side facing away from the camshaft aligned with the longitudinal axis.

DE 38 30 382 C1 discloses the drive of a planetary gear drive mounted axially in front of a superposition drive via an electric control unit, whose longitudinal axis is offset parallel to the longitudinal axis of the camshaft and the superposition drive.

The superposition drive known from U.S. Pat. No. 4,747,375 is constructed as a planetary gear drive, in which for a first construction the ring gear is driven by a servomotor, whose longitudinal axis is arranged parallel to the longitudinal axis of the camshaft, while the sun gear of the planetary gear is in drive connection with the crankshaft of the internal combustion engine and a driven part of the planetary gear relative to the camshaft is realized via the web. For an alternative construction, the drive is realized via the servomotor and the sun gear for aligned alignment of the servomotor relative to the longitudinal axis of the camshaft, while the crankshaft drives the ring gear for a driven part via the web of the planetary gear.

Finally, DE 103 52 255 A1 discloses a coupling of an electric control unit via a flexible shaft, a pneumatic motor, or a hydraulic motor, so that the control unit can be arranged at any point. Furthermore, the publication presents the proposal of arranging an electric control unit parallel to the camshaft and connecting a gear stage between the superposition drive and the electric control unit.

SUMMARY

The present invention is based on the objective of providing a camshaft adjuster with a control unit and a superposition drive, in which driving an accessory unit is possible via the camshaft adjuster.

This objective is met according to the features of the invention. Additional advantageous constructions of the invention follow according to the features of the dependent claims.

According to the invention, first it is provided that an accessory unit is driven by a camshaft adjuster, although this camshaft adjuster is constructed with a superposition drive and a control unit. For this purpose, the accessory unit is in drive connection with one of the gear elements of the superposition drive.

The invention is based on the knowledge that for typical constructions of camshaft adjusters with superposition drives and control assemblies, in which the control unit is arranged on the side of the superposition drive facing away from the camshaft, one end of the camshaft is blocked from the driving of an accessory unit, the attachment of a coupling, and the like. This is especially critical when all of the camshafts allocated to the internal combustion engine are equipped with a camshaft adjuster, which can have the result that The accessory unit must be arranged on an opposite end of the camshaft or The attachment of an additional shaft with a suitable drive must have been performed in the control drive or camshaft drive.

However, this is undesirable, for example, for reasons of packaging, costs, and ease of repair. According to the invention, the preconception of the technical world is dispelled, in that on the end of the camshaft allocated to the camshaft adjuster, a drive of an accessory unit is possible only by the use of a hydraulic camshaft adjuster.

The control unit used according to the invention involves any control unit, which can act as a driving unit and/or as a braking unit. For example, the control unit is an electric control unit or a hydraulic motor.

According to one construction of the invention, the drive of the accessory unit can be enabled so that the control unit is displaced away from the free installation space desired for the drive of the accessory unit on the side of the superposition drive facing away from the camshaft, for example, according to the proposals according to the state of the art named above.

In an alternative construction of the invention, however, the control unit and the accessory unit are arranged on the same side of the superposition drive, that is, on the side of the superposition drive facing the camshaft, so that, especially in tight spacing, the control unit and accessory unit can be arranged, for example, in the region of a cylinder head in the surroundings of a first camshaft bearing. In an alternative construction, both the control unit and also the accessory unit are arranged on the side of the superposition drive facing away from the camshaft.

For allowing an arrangement of the control unit and the accessory unit on the same side of the superposition drive, the invention further provides that an adjustment shaft of the control unit and a drive shaft for the accessory unit are arranged aligned with each other, and that one of the previously mentioned shafts is constructed as a hollow shaft, through which the other shaft extends. In this way, a radially small drive connection with the control unit and also the accessory unit is possible. Furthermore, the control unit and accessory unit themselves can also be at least partially nested one inside the other in the radial direction. It is also possible that the shaft extending through the hollow shaft projects out of the hollow shaft and the associated unit on the side facing away from the superposition drive, so that the control unit and accessory unit are arranged one behind the other in the longitudinal direction of the camshaft. Furthermore, expanded mounting possibilities are given, because, for example, the hollow shaft or the radially outer unit can be mounted opposite the inner shaft or the radially inner unit.

According to another embodiment of a drive connection according to the invention, a control shaft of the control unit and a drive shaft of the accessory unit are also arranged parallel and offset relative to each other. To be able to equalize the parallel offset, the eccentric shaft is connected in a driving way via a gear stage to the gear element of the superposition drive allocated to the eccentric shaft. The gear stage is thus used, on one hand, for transmitting the driving motion to a parallel shaft. Furthermore, the rotational speed of the eccentric shaft and thus of the associated unit as well as the drive torque can be increased or decreased, if desired, by means of the gear stage.

The previously mentioned gear stage can be arranged inside of or outside of a housing of the superposition drive. In particular, a driven wheel of the gear stage is arranged aligned with a longitudinal axis of the superposition drive, which can also have a hollow construction, so that another gear element or an associated shaft can be extended through this element.

For a special construction of the invention, the accessory unit is in drive connection with the camshaft. This construction is based on the knowledge that the rotational speed of the camshaft is changed relatively moderately, for example, in comparison with the adjustment shaft and the control unit. If the accessory unit, for example, the vacuum pump, is driven by means of the gear element allocated to the camshaft, then this accessory unit is driven at a rotational speed that is, for the most part, constant or at a rotational speed correlating to the rotational speed of the internal combustion engine.

Advantageous improvements of the invention emerge from the claims, the description, and the drawings. The advantages of features and combinations of several features noted in the introduction to the description are merely examples, without these necessarily having been derived from embodiments according to the invention. Other features are to be taken from the drawings—especially the illustrated geometries and the relative dimensions of several components relative to each other, as well as their relative arrangement and force connection. The combination of features of different embodiments of the invention or of features of different claims is also possible different from the selected interrelationships of the claims and is proposed herewith. This also relates to features shown in separate drawings or mentioned in their description. These features can also be combined with features of different claims. Likewise, features listed in the claims can be eliminated for other embodiments of the invention.

BRIEF DESCRIPTION OF THE DRAWINGS

Additional features of the invention emerge from the following description and the associated drawings, in which embodiments of the invention are shown schematically. Shown are.

DETAILED DESCRIPTION OF THE PREFERRED EMBODIMENTS

In the figures, components that correspond to each other in terms of their construction and/or function are provided partially with the same reference symbols.

Figure 1:
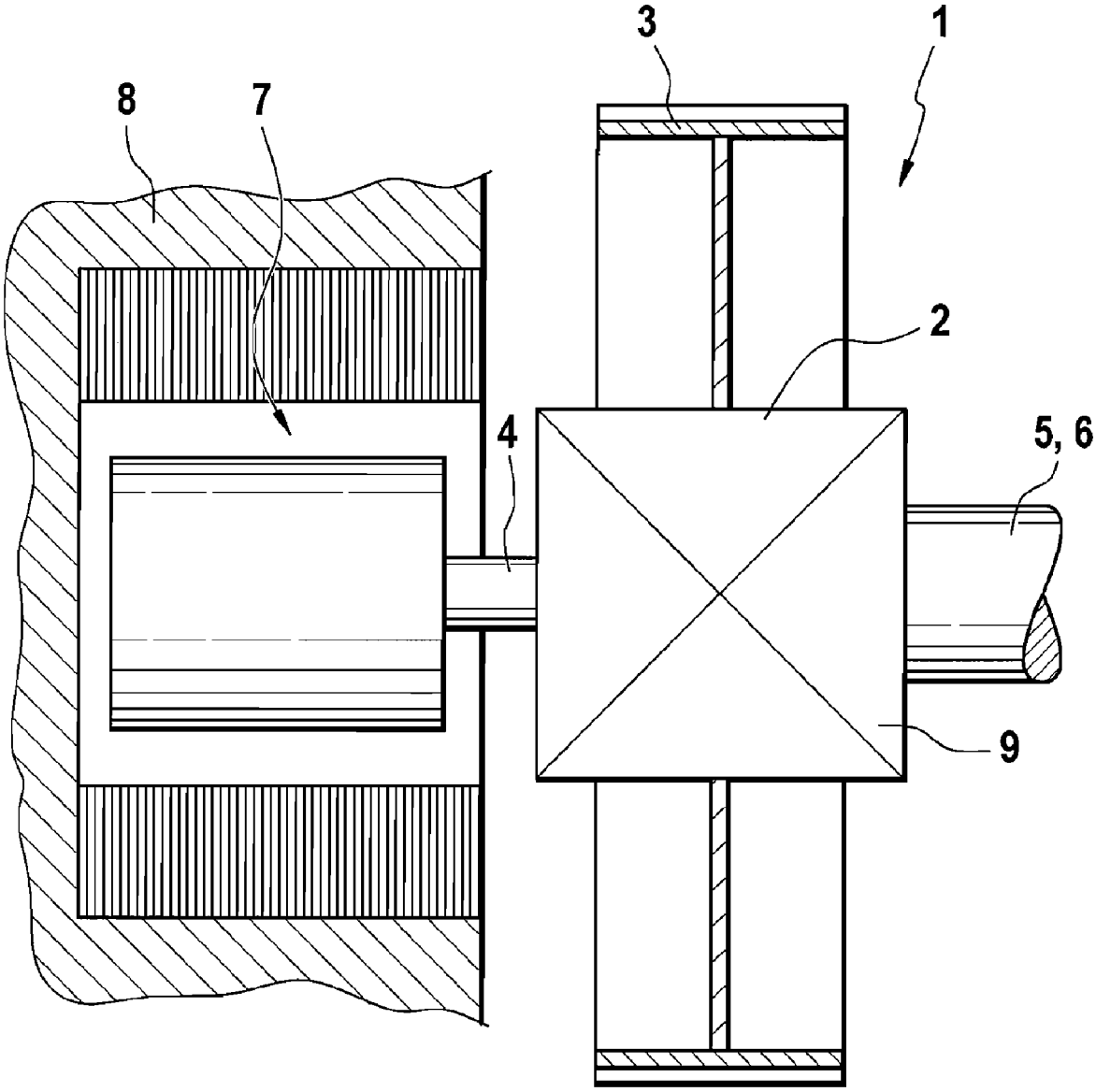
FIG. 1 is a schematic representation of a camshaft adjuster according to the state of the art, in which an electric control unit is arranged on the side of a superposition drive facing away from the camshaft.

FIG. 1 shows in a schematic representation a camshaft adjuster 1, in which, through a superposition drive 2, the movement of two input elements, here a driving wheel 3 and an adjustment shaft 4, is superimposed onto an output motion of an output element, here a driven shaft 5 locked in rotation with a camshaft or directly to the camshaft 6. The driving wheel 3 is in drive connection with a crankshaft of the internal combustion engine, for example, by a tensioning means, such as a chain or a synchronous belt or suitable teeth, and the driving wheel 3 can be constructed as a chain or synchronous belt wheel.

The adjustment shaft 4 is driven by an electric control unit 7 or is in active connection with a brake. The electric control unit 7 is supported relative to the surroundings, for example, the cylinder head 8 or another engine-fixed part.

Figure 2:
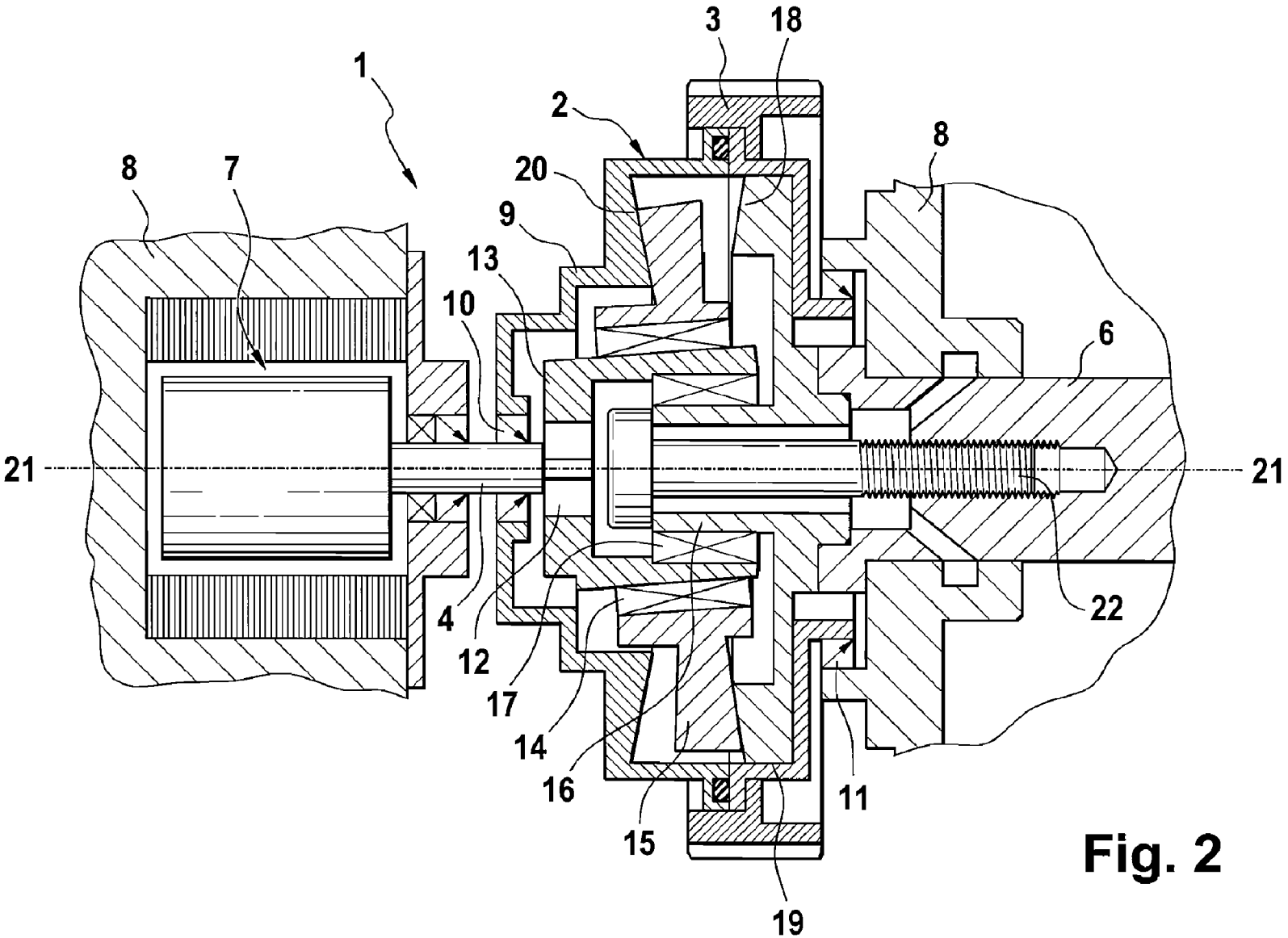
FIG. 2 is a view of a construction of a camshaft adjuster with a swashplate gear according to the state of the art.

FIG. 2 shows an example construction of a camshaft adjuster 1 with a superposition drive 2 in swashplate construction. A housing 9 is located in rotation with the driving wheel 3 and sealed in an axial end region by a sealing element 10 relative to the adjustment shaft 4. In the opposite axial end region, the housing 9 is sealed relative to the cylinder head 8 with a sealing element 11. An end region of the camshaft 6 projects into an interior space formed by the housing 9 and the cylinder head 8. An eccentric shaft or swashplate shaft 13 is connected to the adjustment shaft 4 via a coupling 12, a swashplate 15 supported by a bearing element 14, for example, a roller bearing, and a hollow shaft 16 supported by a bearing element 17, for example, a roller bearing, on the inside in a central recess of the eccentric shaft 13, wherein this hollow shaft carries a driven conical gear wheel 18, are arranged in the interior space. The driven conical gear wheel 18 is supported by a bearing 19 relative to the housing 9. In the interior, the housing 9 forms a driving conical gear wheel 20. The swashplate 15 has suitable teeth on opposite faces. The eccentric shaft 13 with bearing element 14 and swashplate rotate about an axis inclined relative to a longitudinal axis 21-21, so that the swashplate meshes in sub-areas offset relative to each other in the peripheral direction, on one side with the driving conical gear wheel 20 and, on the other side with the driven conical gear wheel 18. An increase or decrease in speed is produced between the driving conical gear wheel and the driven conical gear wheel. The driven conical gear wheel 18 is locked in rotation with the camshaft 6.

For the embodiment shown in FIG. 2, the hollow shaft 16 with the driven conical gear wheel 18 is connected by a central screw 22, which extends through the hollow shaft 16, to the camshaft 6 on the end.

The superposition drive 2 shown in FIG. 2 in the form of a swashplate mechanism is only one example construction of such a superposition drive 2. In FIGS. 3 to 12, the superposition drive 2 is shown only schematically, wherein this superposition drive 2 can be a swashplate construction drive according to FIG. 2 or any other superposition drive, see also the camshaft adjusters, planetary gear drives, or triple-shaft gear drives specified above. For the case of a construction as a planetary gear drive, the gear elements producing the superposition involve A sun gear, A web with planets mounted opposite the web, as well as A ring gear.

For example,

The control unit 7 is connected to the web via the adjustment shaft 4,

The ring gear is connected to the driving wheel 3,

And the sun gear is connected to the camshaft 6.

In an alternative construction, the gear elements producing the superposition involve, for example, an axially moving adjustment element, which is acted upon by the control unit and interacts with a driving wheel-fixed thread and a camshaft-fixed thread, cf. e.g., EP 1 403 470 A1.

Figure 3:
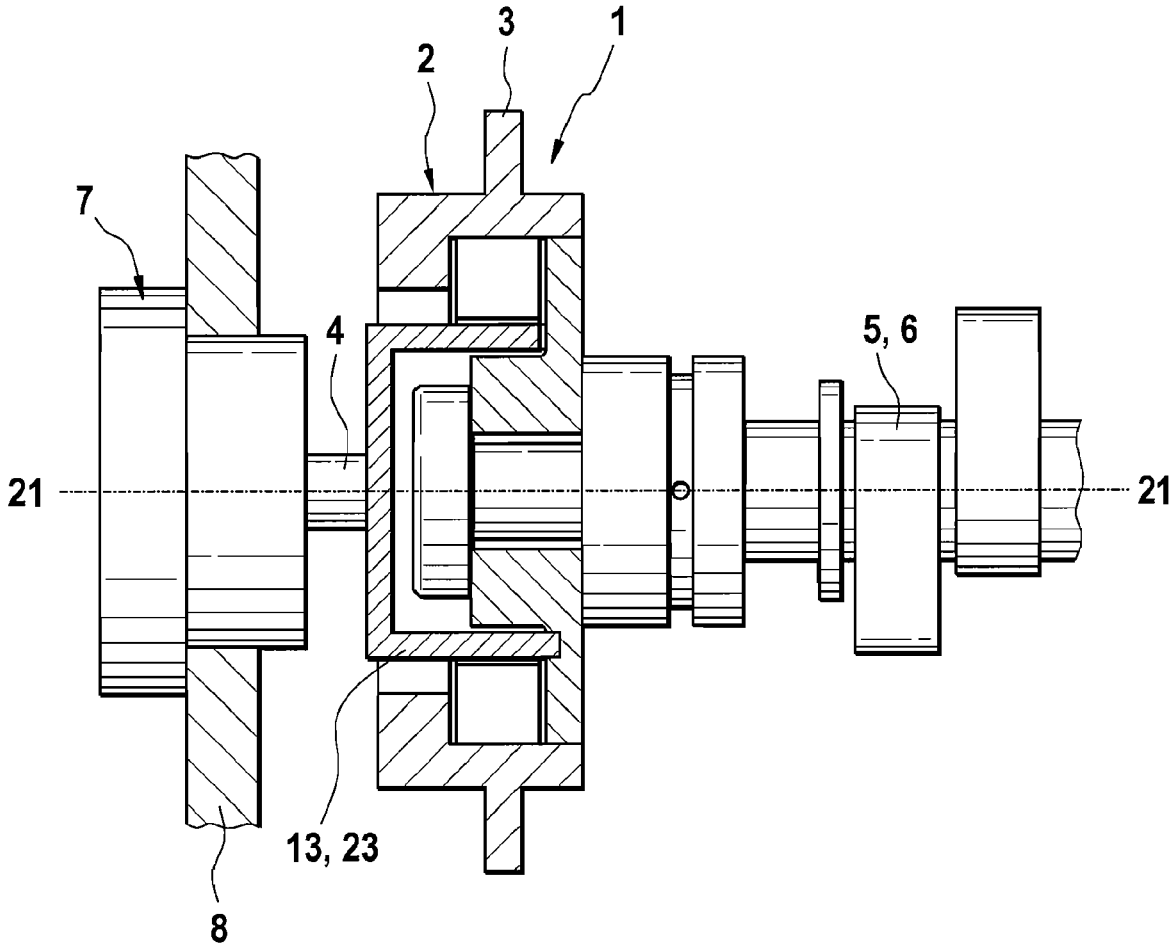
FIG. 3 is a view of a drive connection with an electric control unit, which is arranged on the side facing away from the camshaft and which is connected via an adjustment shaft to a web or an intermediate element of the superposition drive.

For the embodiment shown in FIG. 3, the electrical control unit 7 is arranged on the side of the superposition drive 2 facing away from the camshaft 6. The electrical control unit 7 is supported opposite the cylinder head 8. The adjustment shaft 4 extends via an eccentric shaft 13 or a web 23 into the superposition drive 2 and is in drive connection here with the other gear elements of the superposition drive 2.

Figure 4:
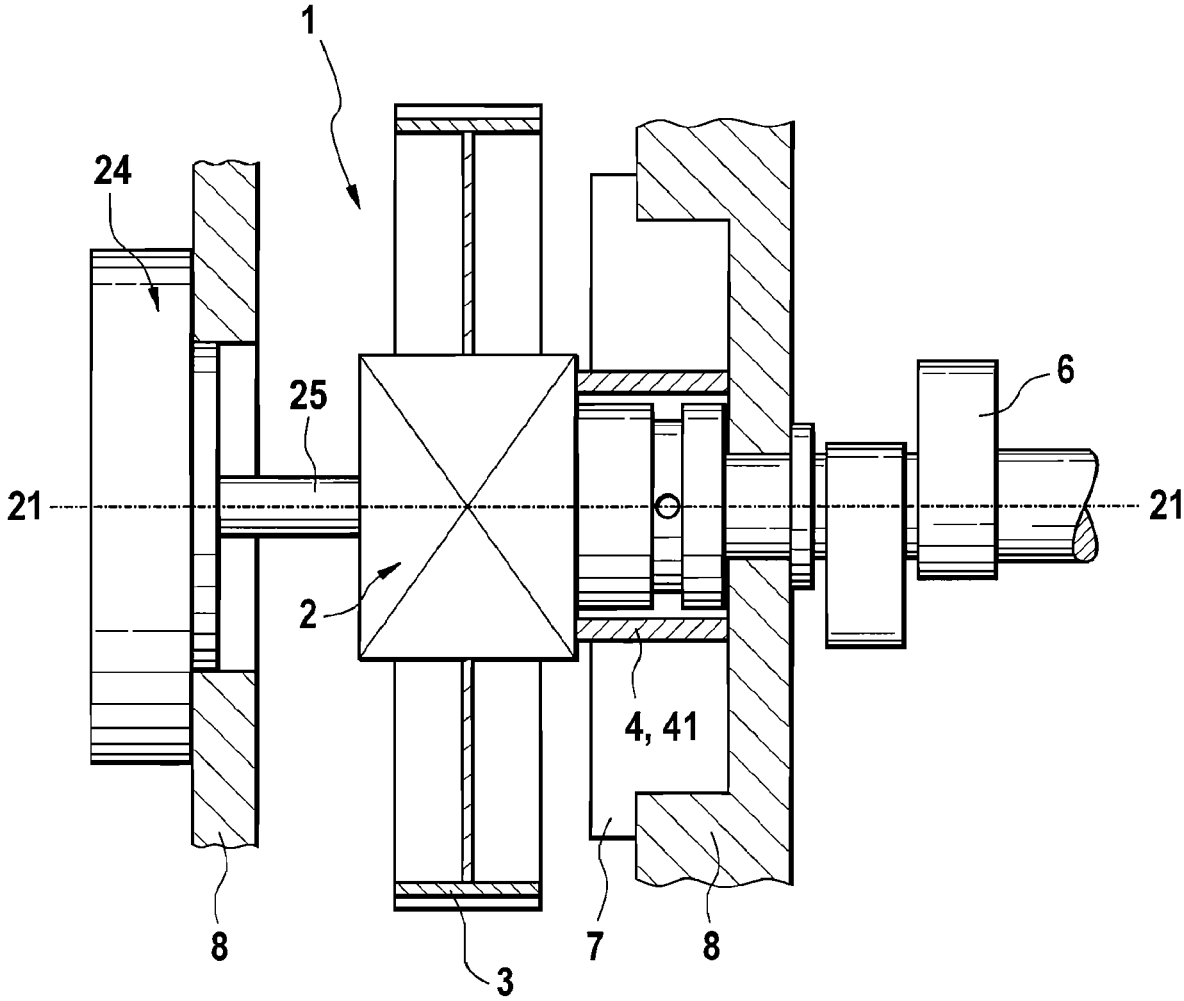
FIG. 4 is a view of a drive connection, in which an electric control unit is arranged radially outside of the camshaft and the accessory unit is arranged on the side facing away from the camshaft.

For the embodiment shown in FIG. 4, the superposition drive 2 is shown only schematically. An accessory unit 24 is arranged on the side of the superposition drive 2 facing away from the camshaft 6 and supported opposite the cylinder head 8. The accessory unit 24 is connected to the associated gear element of the superposition drive 2 via a drive shaft 25 arranged aligned with the longitudinal axis 21-21. On the side facing the camshaft 6, the electrical control unit 7 is arranged, which extends radially on the outside around the camshaft 6 and drives a hollow shaft 41, which is oriented aligned to the camshaft 6 and longitudinal axis 21-21 and which enters into the superposition drive 2 in a sealed way through a suitable recess of the superposition drive 2 and is here connected to the gear element allocated to the control unit 7.

Figure 5:
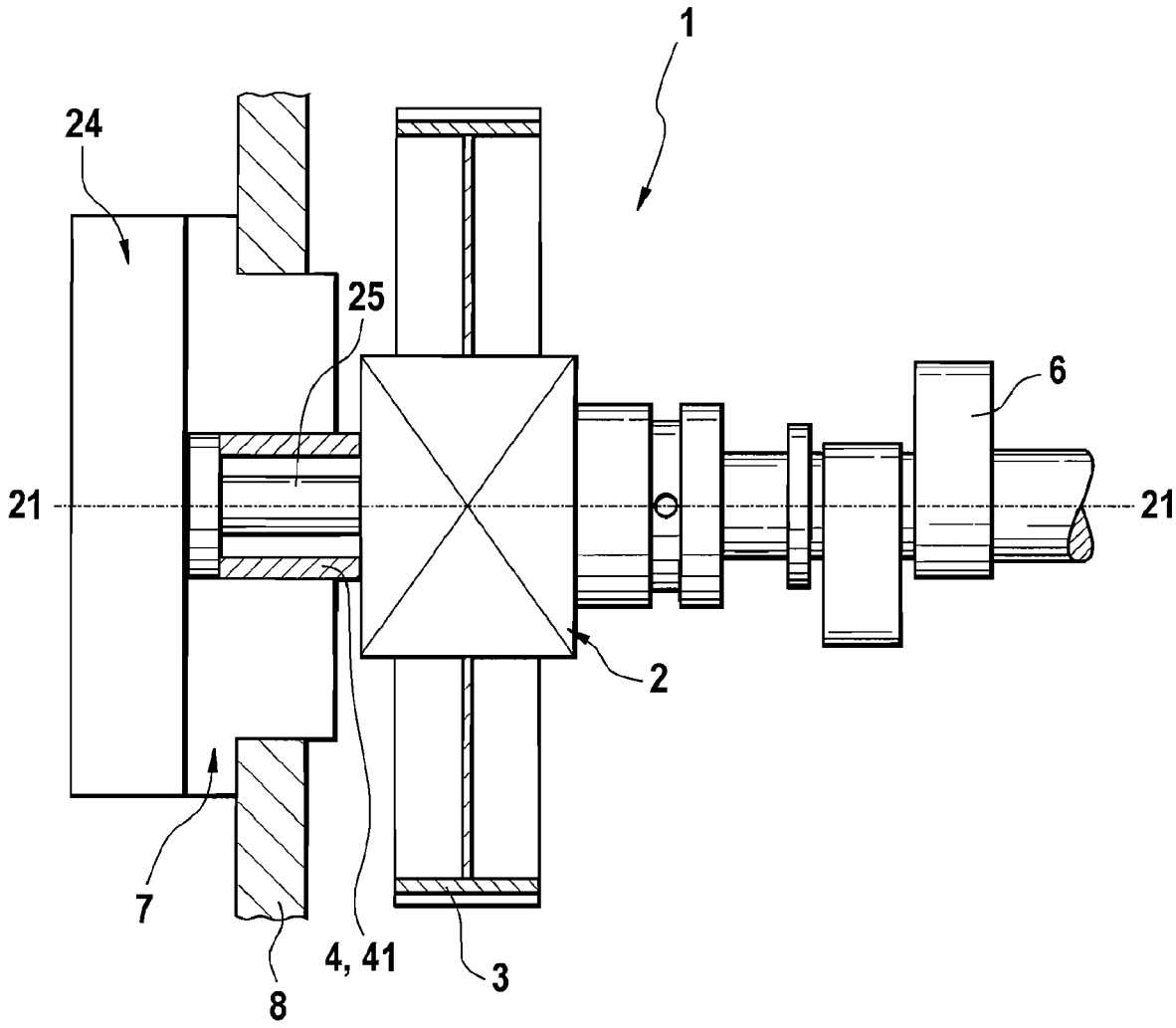
FIG. 5 is a view of a drive connection, in which the accessory unit and electric control unit are arranged on the side of the superposition drive facing away from the camshaft with a coaxial arrangement one lying behind the other.

For the embodiment shown in FIG. 5, both the accessory unit 24 and also the control unit 7 are arranged on the side facing away from the camshaft 6 of the superposition drive 2 and supported together opposite the cylinder head 8. The control unit 7 is supported directly opposite a wall of the cylinder head 8 and extends around the adjustment shaft 4 constructed as a hollow shaft. The drive shaft 25 of the accessory unit 24 extends through the adjustment shaft 4 to the accessory unit 24, which is supported on the control unit on the side of the control unit 7 facing away from the superposition drive 2. Different from the embodiment shown in FIG. 5, the control unit 7 and accessory unit 24 can be constructed as a common unit, especially with a common housing.

Figure 6:
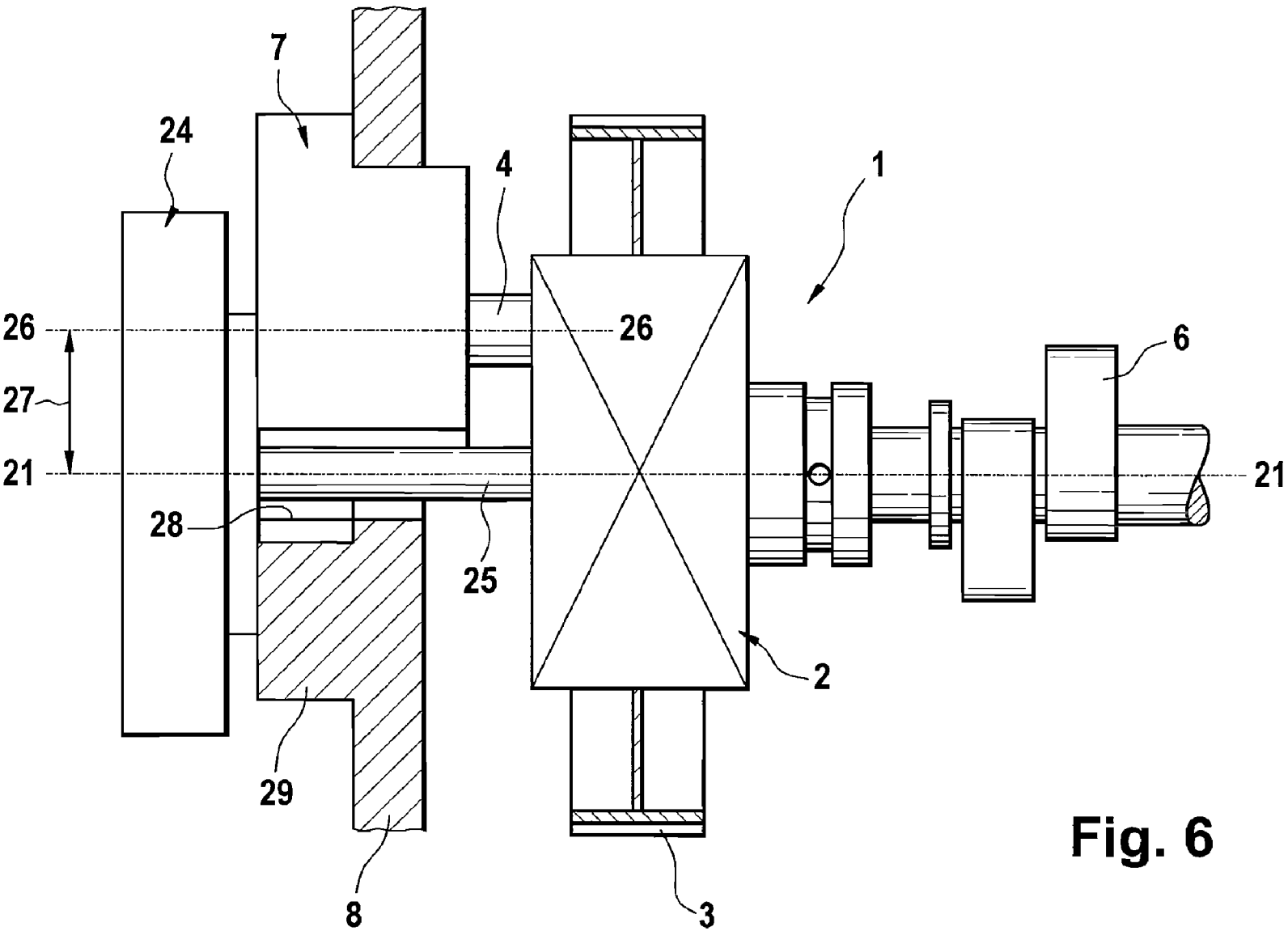
FIG. 6 is a view of a drive connection, in which the accessory unit and electric control unit are arranged on the side facing away from the camshaft, parallel and offset relative to each other and lying axially one behind the other and a gear stage is located in the superposition drive.

For the embodiment shown in FIG. 6, the control unit 7 and accessory unit 24 are arranged on the side of the superposition drive 2 facing away from the camshaft 6, with a longitudinal axis 26-26 of the control unit 7 being arranged parallel to the longitudinal axis 21-21 with an offset 27. The electrical control unit 7 is supported directly opposite the cylinder head 8 and feeds its drive motion into the superposition drive 2 via the adjustment shaft 4 away from the longitudinal axis 21-21, wherein a gear stage can be connected between the adjustment shaft 4 and the gear element allocated to the adjustment shaft 4. Apart from the longitudinal axis 26-26, the control unit 7 has a recess 28, through which the drive shaft 25 of the accessory unit 24 is guided. The drive shaft 25 and the accessory unit 24 are arranged aligned to the longitudinal axis 21-21. The accessory unit 24 is supported on the side of the control unit 7 facing away from the superposition drive 2 on the control unit and/or on the cylinder head 8 or a corresponding shoulder 29 of this cylinder head. For the embodiment shown in FIG. 6, the adjustment shaft 4 can also be connected to the associated gear element of the superposition drive 2 via a gear stage not shown in FIG. 6 in the interior of the superposition drive 2.

Figure 7:
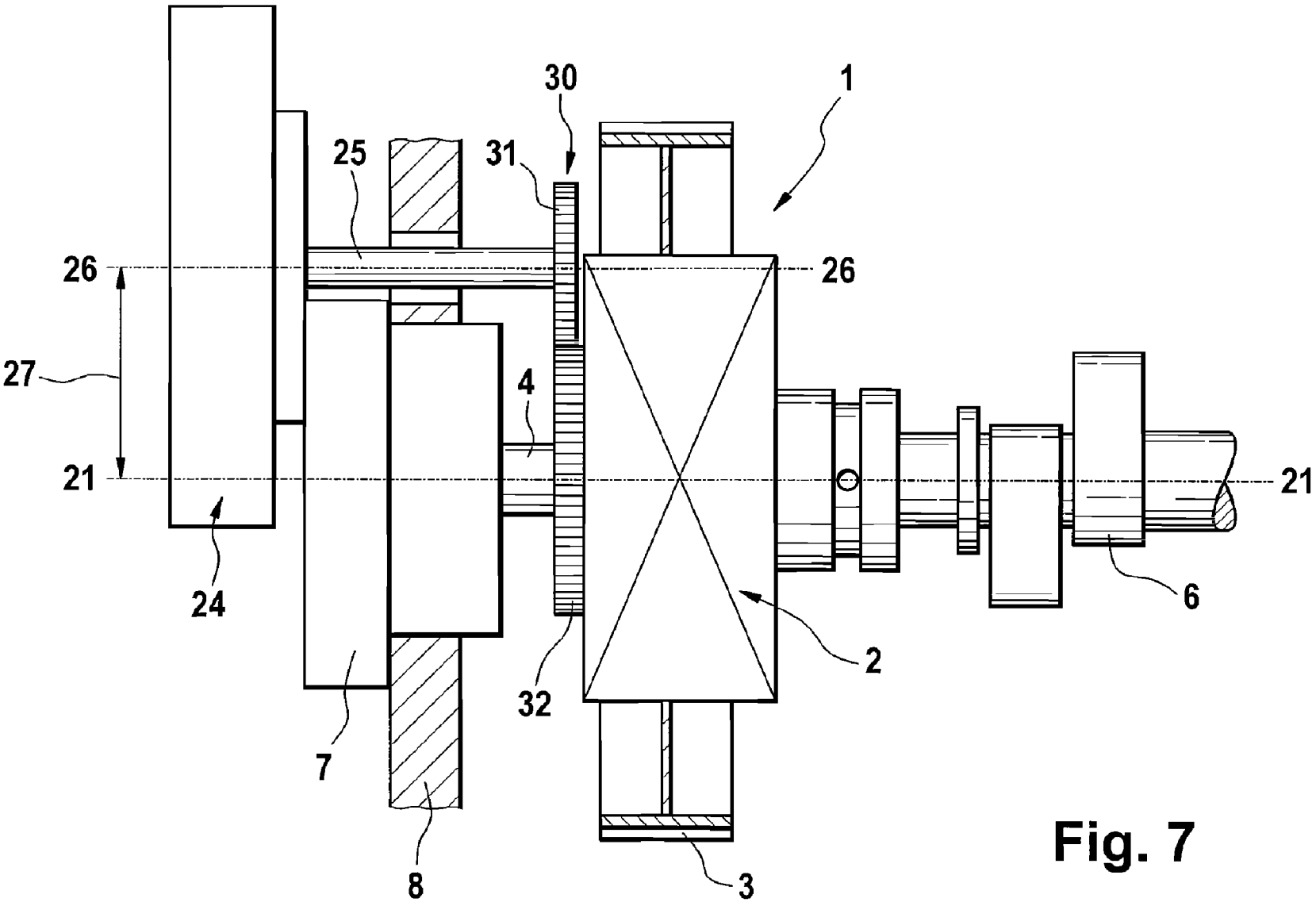
FIG. 7 is a view of a drive connection, in which the accessory unit and electric control unit are arranged on the side facing away from the camshaft, parallel and offset relative to each other and lying axially one behind the other and a gear stage is located outside of the superposition drive.

According to FIG. 7, the control unit 7 is arranged aligned with the longitudinal axis 21-21 and is supported directly on the cylinder head 8. The adjustment shaft 4 enters into the housing of the superposition drive aligned with the longitudinal axis 21-21. On the rear side of the control unit 7, the accessory unit 24 is supported, whose longitudinal axis 26-26 is arranged eccentric via the offset 27 to the longitudinal axis 21-21. The drive shaft 25 of the accessory unit 24 is connected to the associated gear element of the superposition drive 2 via a gear stage 30. For the embodiment shown in FIG. 7, the gear stage 30 is constructed as a spur wheel stage with a driving gear wheel 31, which is locked in rotation with the drive shaft 25, and with a driven gear wheel 32, which meshes with the driving gear wheel 31 and which feeds its driving motion into the superposition drive 2 or absorbs power and is locked in rotation, for example, directly to a gear element of the superposition drive 2. The driven gear wheel 32 and optionally an allocated shaft and/or a gear element are constructed as hollow bodies, through which the adjustment shaft 4 and an associated gear element can be guided.

Figure 8:
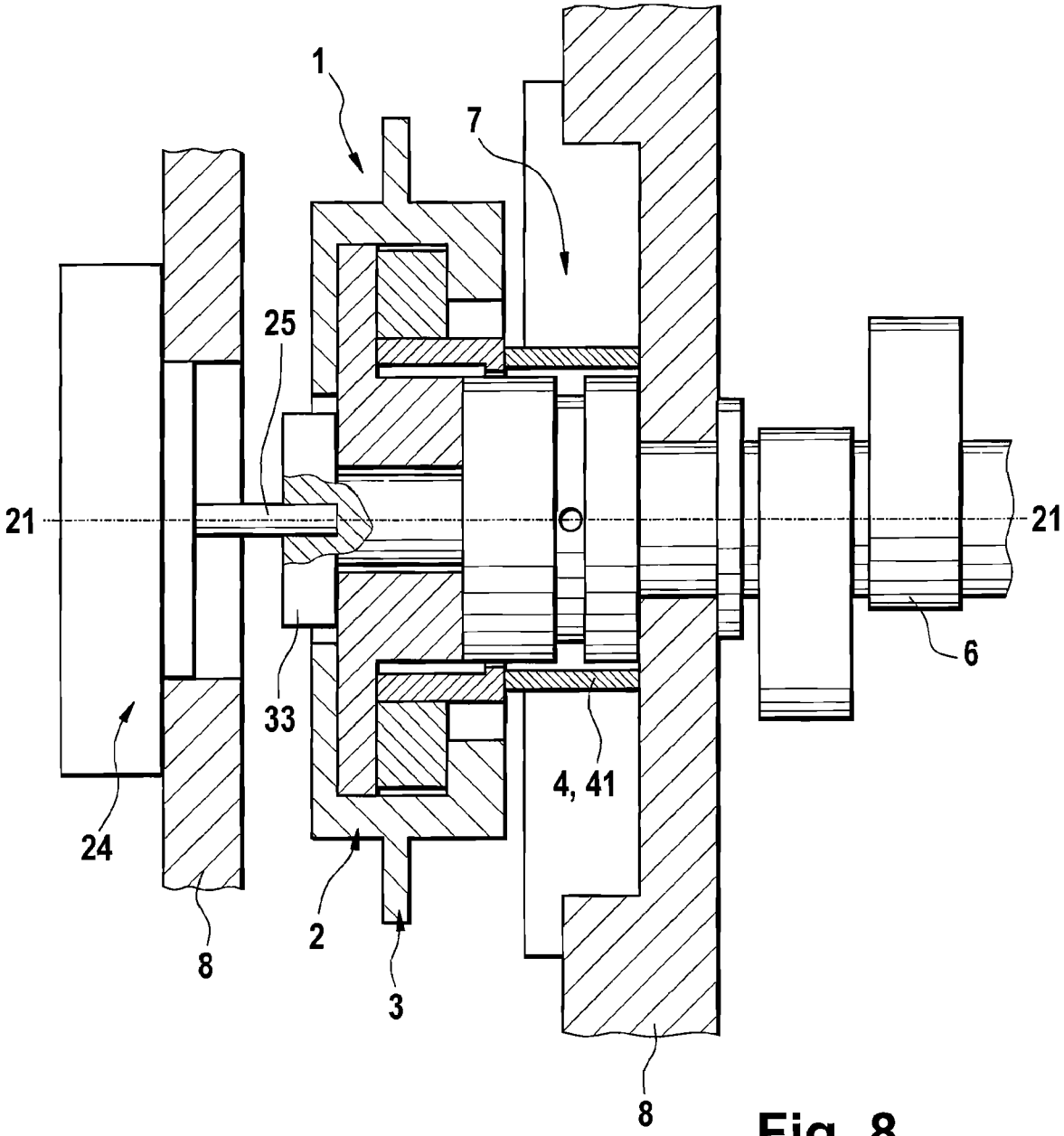
FIG. 8 is a view of a drive connection, in which the accessory unit is driven by the gear element allocated to the camshaft and the electric control unit and accessory unit are arranged on different sides of the superposition drive.

FIG. 8 shows an embodiment, in which the camshaft adjuster 1 has a control unit 7, which is supported opposite the cylinder head 8, on the side facing the camshaft 6. The control unit 7 is equipped with a central bore, through which the camshaft 6 passes. The control unit 7 drives an adjustment shaft 4, which is constructed as a hollow shaft 41 and through the camshaft 6 passes, which enters into a housing of the superposition drive 2 especially in a sealed way and which is locked in rotation with a suitable gear element of the superposition drive 2, especially a web. The drive shaft 25 of the accessory unit 24 is connected to the camshaft and the gear element of the superposition drive 2 allocated to the camshaft via a central screw 33 shown schematically in FIG. 8. The accessory unit 24 is supported on the side of the superposition drive 2 facing away from the camshaft 6 on a wall or a carrier of the cylinder head 8.

Figure 9:
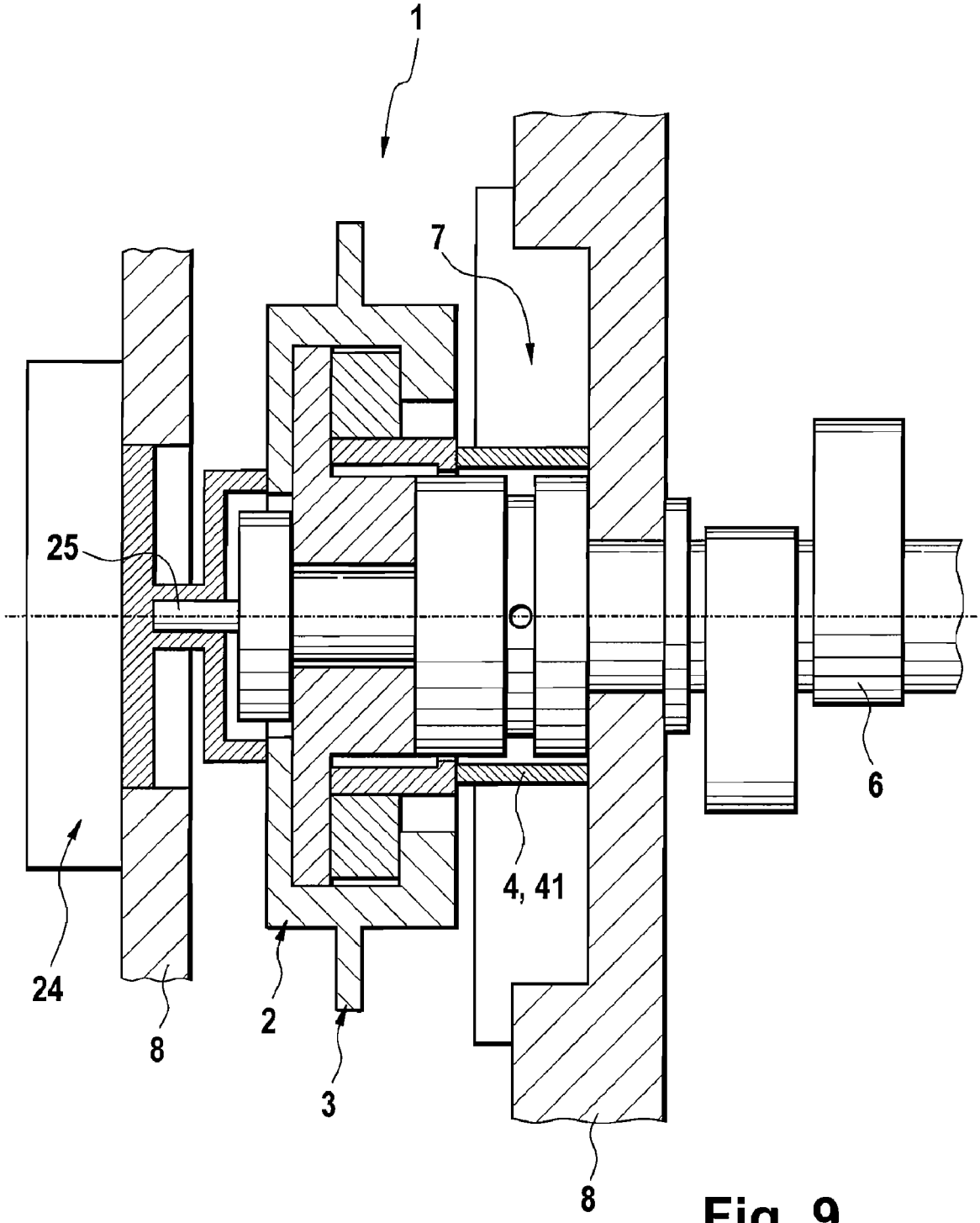
FIG. 9 is a view of a drive connection, in which the accessory unit is driven by the gear element allocated to the driving wheel and the accessory unit and electric control unit are arranged on different sides of the superposition drive.

For the embodiment shown in FIG. 9, the control unit 7 and its coupling to the cylinder head 8, as well as the feeding of the drive power of the control unit 7, are arranged essentially according to the embodiment shown in FIG. 8. In this case, the accessory unit 24 and its drive shaft 25 are locked in rotation with the driving wheel 3.

For the embodiments shown in FIGS. 3 to 9, in one modification, the accessory unit 24 and the control unit 7 can be interchanged.

Figure 10:
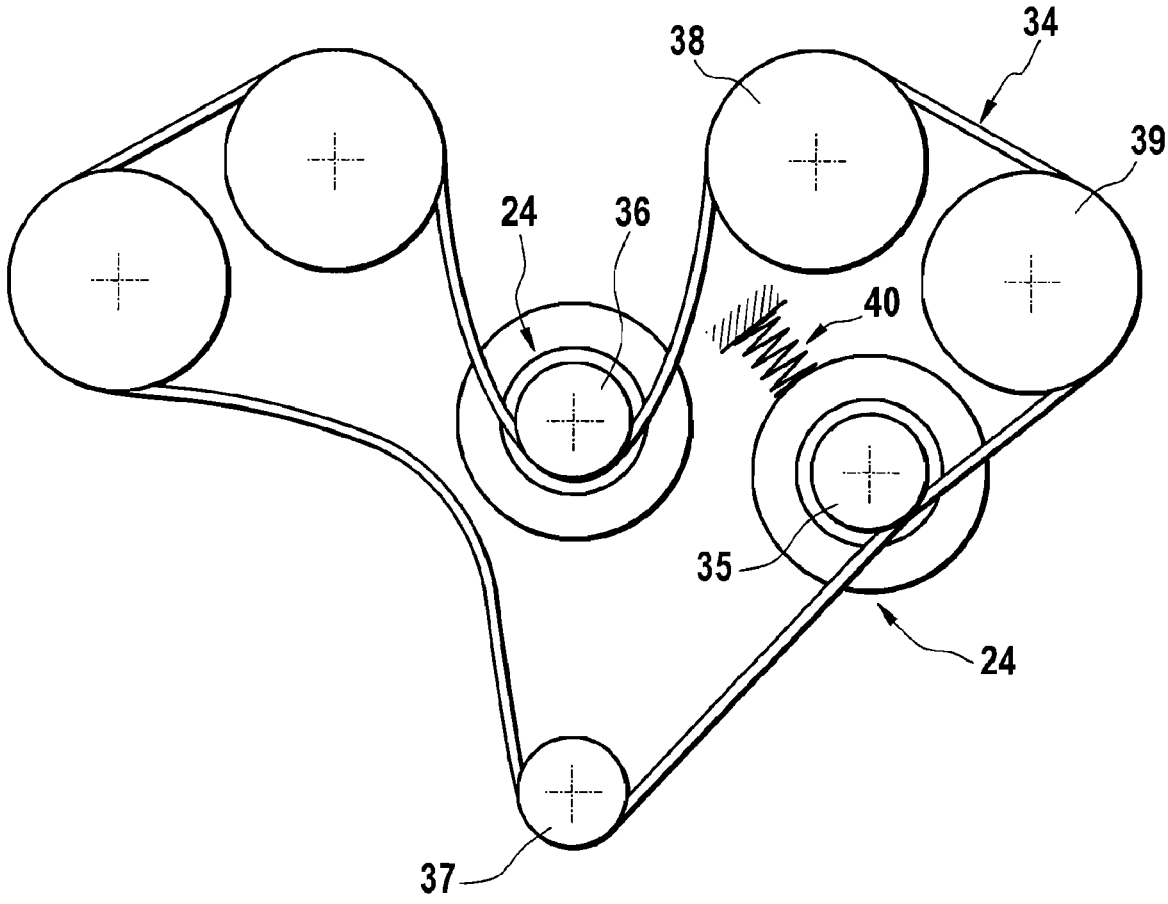
FIG. 10 is a view of a connection of an accessory unit directly over a control drive.

For the embodiment shown in FIG. 10, the accessory unit 24 is driven directly via the control or unit drive 34 by an additional driving wheel 35 or a roller in driving connection with the traction mechanism, especially a timing chain or a timing belt. The control drive 34 is driven by a pinion 37 of the crankshaft. A driving wheel 38 allocated to an inlet camshaft, as well as a driving wheel 39 allocated to an outlet camshaft, is in drive connection with the control drive 34. Thus the tension in the traction mechanism of the control drive 34 is not affected and, for example, a bearing of the accessory unit is not excessively loaded with the chain biasing. In the case of the use of an additional driving wheel 35 for the drive of the accessory unit 24 the driving wheel 35 can be supported approximately in the direction normal to the traction mechanism via a suitable spring direction 40. The driving wheel 35 with the accessory unit 24 is therefore in the position to follow or balance out possible changes in the position of the allocated traction mechanism through a variable tension in the traction mechanism. Alternatively or cumulatively, the attachment of an accessory unit 24 is possible via a driving wheel 36 of the control drive 34 constructed as a deflection wheel.

The control unit 7 can be constructed as an electric motor or electromagnetic adjustment system or in the form of an electric brake. The drive of the accessory unit 24 can be realized by:

a) The driving wheel 3 or a gear element of the superposition drive 2 locked in rotation with the driving wheel 3;

b) The camshaft or a gear element of the superposition drive locked in rotation with the camshaft; and c) The control unit 7 or the adjustment shaft 4 or an allocated gear element of the superposition drive 2.

If the accessory unit 24 is driven according to variant c), preferably an extended adjustment shaft 4 is necessary. Such an adjustment shaft 4, however, is increased to a relatively high speed relative to the rotational speed of the camshaft 6 under some circumstances, in order to be able to produce a phase adjustment of the camshaft adjuster 1 with relatively small moments of the control unit 7. If the accessory unit 24 is driven via the adjustment shaft 4, it is advantageous when the control unit 7 and the associated control electronics have significantly larger dimensions. Furthermore, it is to be taken into account that in the case of a camshaft adjustment, the accessory unit is operated temporarily with a clear change in rotational speed and a clearly different relative rotational speed compared with the rotational speed of the camshaft 6.

For driving the accessory unit 24 according to variant b), changes in the rotational speed and the rotational speeds are relatively moderate. In this case, however, it is to be taken into account that the accessory unit 24 is also exposed to a phase shift necessarily in a period during a phase shift of the camshaft adjuster. In this case, the control unit 7 preferably also has an accordingly reinforced construction, so that a dragging moment of the accessory unit 24 can also be overcome. Here, initial start-up torques of an accessory unit 24, such as, for example, a vacuum pump, are also to be taken into account for use at low temperatures.

In principle, for the arrangement of an accessory unit, constructed below, for example, as a vacuum pump, and control unit, constructed below as an electric motor or brake, the following variants are conceivable:

A) Drive of vacuum pump central, electric motor or brake as hollow shaft motor/brake constructed on the camshaft side;

B) Drive of vacuum pump central, electric motor or brake as hollow shaft motor/brake on the side facing away from the camshaft, shaft of the vacuum pump with relatively small diameter fed through, therefore more favorable energetically, because friction radii in electric motor/brake are smaller;

C) Drive of vacuum pump central, electric motor or brake engage eccentrically on the control unit, radially projecting brakes/electric motors, feed through of pump drive shaft necessary, rotary feed through only through the stationary parts of the actuator (e.g., through stator or only through housing);

D) Drive of vacuum pump eccentrically, electric motor or brake according to state of the art, the axle offset can be used simultaneously, an additional speed-changing stage for the drive of the vacuum pump to be integrated, through the vacuum pump then set to a rotational speed, e.g., higher than the camshaft, this has a higher pumping volume for the same crankshaft rotational speed and can thus have a smaller construction. Furthermore, due to higher rotational speed there are smaller pressure fluctuations, the rotational speed conversion can be realized through a simple combination of pump-fixed and chain wheel-fixed pinions.

LIST OF REFERENCE SYMBOLS

1 Camshaft adjuster
2 Superposition drive
3 Driving wheel
4 Adjustment shaft
5 Driven shaft
6 Camshaft
7 Control unit
8 Cylinder head
9 Housing
10 Sealing element
11 Sealing element
12 Coupling
13 Eccentric shaft
14 Bearing element
15 Swashplate
16 Hollow shaft
17 Bearing element
18 Driven conical gear wheel
19 Bearing
20 Driving conical gear wheel
21 Longitudinal axis
22 Central screw
23 Web
24 Accessory unit
25 Drive shaft
26 Longitudinal axis
27 Offset
28 Recess
29 Shoulder
30 Gear stage
31 Driving gear wheel
32 Driven gear wheel
33 Central screw
34 Control drive
35 Driving wheel
36 Driving wheel
37 Pinion
38 Driving wheel
39 Driving wheel
40 Spring device
41 Hollow shaft

The invention claimed is:

1. A drive connection with a camshaft adjuster for an internal combustion engine, comprising a superposition drive with first, second and third gear elements, of which the first gear element is allocated to a camshaft, the second gear element is allocated to a driving wheel, and the third gear element is allocated to a control unit, and an accessory unit is in drive connection with one of the gear elements of the superposition drive; and the control unit and the accessory unit are arranged on a same side of the superposition drive.

2. The drive connection according to claim 1, wherein an adjustment shaft of the control unit and a drive shaft of the accessory unit are arranged parallel to one another with an offset, and the offset drive shaft of the accessory unit is connected in a driving manner to the gear element via a gear stage.

3. A drive connection with a camshaft adjuster for an internal combustion engine, comprising a superposition drive with first, second and third gear elements, of which the first sear element is allocated to a camshaft, the second gear element is allocated to a driving wheel, and the third gear element is allocated to a control unit, and an accessory unit is in drive connection with one of the gear elements of the superposition drive;

the control unit and the accessory unit are arranged on a same side of the superposition drive; and an adjustment shaft of the control unit and a drive shaft of the accessory unit are arranged aligned with each other and one of the shafts is constructed as a hollow shaft, through which the other shaft passes.

4. The drive connection according to claim 3, wherein the accessory unit is in drive connection with the camshaft.

* * * * *